US008074741B2

(12) United States Patent
Meister

(10) Patent No.: US 8,074,741 B2
(45) Date of Patent: Dec. 13, 2011

(54) METHODS, SYSTEMS, AND BOTTOM HOLE ASSEMBLIES INCLUDING REAMER WITH VARYING EFFECTIVE BACK RAKE

(75) Inventor: Matthias Meister, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 195 days.

(21) Appl. No.: 12/428,580

(22) Filed: Apr. 23, 2009

(65) Prior Publication Data

US 2009/0266614 A1 Oct. 29, 2009

Related U.S. Application Data

(60) Provisional application No. 61/047,355, filed on Apr. 23, 2008.

(51) Int. Cl.
*E21B 10/26* (2006.01)
*E21B 10/16* (2006.01)

(52) U.S. Cl. ..... 175/57; 175/385; 175/391; 175/406; 175/431

(58) Field of Classification Search ..... 175/57, 175/385, 391, 406, 431
See application file for complete search history.

(56) References Cited

U.S. PATENT DOCUMENTS 5,497,842 A * 3/1996 Pastusek et al. ..... 175/334
5,649,604 A 7/1997 Fuller et al.
5,678,644 A * 10/1997 Fielder ..... 175/391
5,957,223 A * 9/1999 Doster et al. ..... 175/57
5,979,577 A 11/1999 Fielder
5,992,548 A 11/1999 Silva et al.
RE36,817 E * 8/2000 Pastusek et al. ..... 175/334
6,200,514 B1 3/2001 Meister
6,269,893 B1 * 8/2001 Beaton et al. ..... 175/391
6,298,930 B1 10/2001 Sinor et al.
6,332,503 B1 12/2001 Pessier et al.
6,340,064 B2 1/2002 Fielder et al.
6,460,631 B2 10/2002 Dykstra et al.
6,659,207 B2 * 12/2003 Hoffmaster et al. ..... 175/391
6,729,420 B2 5/2004 Mensa-Wilmot
6,779,613 B2 8/2004 Dykstra et al.
6,920,944 B2 * 7/2005 Eppink et al. ..... 175/53
6,935,441 B2 8/2005 Dykstra et al.

(Continued)

OTHER PUBLICATIONS

Written Opinion of the International Searching Authority for International Application No. PCT/US2009/041526 dated Jan. 19, 2010, 6 pages.

(Continued)

*Primary Examiner* — Jennifer H Gay
(74) *Attorney, Agent, or Firm* — TraskBritt

(57) ABSTRACT

Reamer bits have cutters with different effective back rake angles. Drilling systems include a pilot bit and a reamer bit, wherein cutters in shoulder regions of the reamer bit have a greater average effective back rake angle than cutters in shoulder regions of the pilot bit. Methods of drilling wellbores include drilling a bore with a pilot bit, and reaming the bore with a reamer bit having cutters in shoulder regions of the reamer bit that have an average effective back rake angle greater than that of cutters in shoulder regions of the pilot bit. Methods of forming drilling systems include attaching pilot and reamer bits to a drill string, and positioning cutters in shoulder regions of the reamer bit to have an average effective back rake angle greater than that of cutters in shoulder regions of the pilot bit.

28 Claims, 7 Drawing Sheets

U.S. PATENT DOCUMENTS

| | | | | |
|---|---|---|---|---|
| 7,096,978 | B2 | 8/2006 | Dykstra et al. | |
| 7,441,612 | B2 * | 10/2008 | Durairajan et al. | 175/431 |
| 2006/0162968 | A1 * | 7/2006 | Durairajan et al. | 175/431 |
| 2006/0167668 | A1 * | 7/2006 | Cariveau et al. | 703/7 |
| 2006/0167669 | A1 * | 7/2006 | Cariveau et al. | 703/7 |
| 2006/0180356 | A1 * | 8/2006 | Durairajan et al. | 175/431 |
| 2008/0128174 | A1 | 6/2008 | Radford et al. | |
| 2008/0128175 | A1 | 6/2008 | Radford et al. | |
| 2009/0030658 | A1 * | 1/2009 | Durairajan et al. | 703/1 |
| 2009/0152018 | A1 * | 6/2009 | Sani | 175/432 |
| 2009/0266614 | A1 * | 10/2009 | Meister | 175/57 |
| 2010/0193248 | A1 | 8/2010 | Radford et al. | |
| 2010/0276201 | A1 * | 11/2010 | Makkar et al. | 175/57 |
| 2011/0005841 | A1 * | 1/2011 | Wood et al. | 175/385 |

OTHER PUBLICATIONS

International Search Report for International Application No. PCT/US2009/041526 dated Jan. 19, 2010, 4 pages.

Written Opinion of the International Searching Authority for International Application No. PCT/US2010/022540 dated Jun. 16, 2010, 3 pages.

International Search Report for International Application No. PCT/US2010/022540 dated Jun. 16, 2010, 3 pages.

Radford et al., Novel Concentric Expandable Stabilizer Results in Increased Penetration Rates and Drilling Efficiency with Reduced Vibration, International Association of Drilling Contractors, SPE/IADC 119534, Drilling Conference and Exhibition held in Amsterdam, The Netherlands, Mar. 17-19, 2009 (13 pages).

Thomson et al., A Systematic Approach to a Better Understanding of the Concentric Hole-Opening Process Utilizing Drilling Mechanics and Drilling Dynamics Measurements Recorded Above and Below the Reamer, IADC/SPE 112647 Drilling Conference held in Orlando, Florida, Mar. 4-6, 2008 (20 pages).

* cited by examiner

TABLE 1

| | ELEMENT | PA | BRK | SRK | EFF.BRK |
|---|---|---|---|---|---|
| 310 PILOT BIT | $P_1$ | -20 | 15 | 3 | 13.1 |
| | $P_2$ | -20 | 15 | 3 | 13.1 |
| | $P_3$ | 0 | 15 | 3 | 15 |
| | $P_4$ | 45 | 15 | 3 | 12.7 |
| | $P_5$ | 60 | 15 | 3 | 10.1 |
| | $P_6$ | 80 | 15 | 3 | 5.6 |
| | $P_7$ | 90 | 15 | 3 | 3 |
| 350 REAMER BIT | $R_1$ | 60 | 15 | 25 | 29.2 |
| | $R_2$ | 70 | 15 | 20 | 23.9 |
| | $R_3$ | 75 | 15 | 15 | 18.4 |
| | $R_4$ | 80 | 15 | 10 | 12.5 |
| | $R_5$ | 85 | 15 | 5 | 6.3 |
| | $R_6$ | 90 | 15 | 5 | 5 |

METHODS, SYSTEMS, AND BOTTOM HOLE ASSEMBLIES INCLUDING REAMER WITH VARYING EFFECTIVE BACK RAKE

CROSS-REFERENCE TO RELATED APPLICATIONS

This application claims the benefit of U.S. Provisional Patent Application Ser. No. 61/047,355 filed Apr. 23, 2008, and titled "Reamer Drill Bit with Varying Effective Back-rake," the disclosure of which is incorporated herein in its entirety by this reference. The subject matter of this application is related to U.S. patent application Ser. No. 12/696,735, filed Jan. 29, 2010, pending, which claims the benefit of U.S. Provisional Patent Application Ser. No. 61/148,695, filed Jan. 30, 2009.

TECHNICAL FIELD

This disclosure relates generally to reamer drill bits for use in drilling wellbores, to bottom hole assemblies and systems incorporating reamer drill bits, and to methods of making and using such reamer bits, assemblies and systems.

BACKGROUND

Oil wells (wellbores) are usually drilled with a drill string. The drill string includes a tubular member having a drilling assembly that includes a single drill bit at its bottom end. However, sometimes the drill string includes two spaced-apart drill bits: the first at the bottom of the drilling assembly (referred to as the "pilot drill bit" or "pilot bit") to drill the wellbore of a first smaller wellbore diameter; and the second drill bit located above, or uphole of, the pilot bit (referred to as the "reamer bit" or "reamer") to enlarge the wellbore drilled by the pilot bit.

Pilot bits typically include several regions, such as a nose, cone, lower shoulder or lower region and an upper shoulder or upper region, each region having thereon cutting elements (also referred to as "cutters") that cut into the formation to drill the wellbore of the first smaller diameter. The reamer bit typically includes a lower shoulder or lower region and an upper shoulder or upper region, each such region having a number of cutting elements, which cut into the formation to enlarge the wellbore of the first smaller wellbore. The orientation of a front cutting face of a cutting element may be characterized by a back rake angle and side rake angle, which, in combination with the profile angle of the cutting element, define an effective back rake (or aggressiveness) of the cutting element. The load on a region of a bit during drilling of the wellbore depends upon the effective back rake of the cutting elements in that region. Uneven load distribution between the reamer and the pilot bit often causes problems, especially when the pilot bit is in a soft formation while the reamer bit is in a relatively hard formation. Under such drilling conditions, the reamer bit lower region is typically under a greater load compared to the load on the pilot bit, which can damage the reamer bit or wear it out quickly, while the pilot bit is still in an acceptable condition. The reason generally is that the effective back rake of the lower region of commonly used reamer bits is relatively low (i.e., the aggressiveness is relatively high).

Therefore, there is a need for an improved reamer bit which may be used to selectively distribute (e.g., even) the load between the reamer bit and an associated pilot bit for use in drilling wellbores.

BRIEF SUMMARY OF THE INVENTION

In some embodiments, the present invention includes reamer bits having a generally tubular body extending between a first end and a second end, and a plurality of cutting elements carried by the body between the first end and the second end thereof. The tubular body is configured for attachment to a drill string. The effective back rake angle of at least one cutting element of the plurality is about fifteen degrees (15°) or more.

In additional embodiments, the present invention includes reamer bits having a generally tubular body extending between a first end and a second end, and a plurality of cutting elements carried by the tubular body between the first end and the second end thereof. The tubular body is configured for attachment to a drill string. The cutting elements define a cutting profile of the reamer bit removed from a longitudinal axis of the reamer bit, and at least one cutting element of the plurality of cutting elements has a side rake angle of about five degrees (5°) or more.

In additional embodiments, the present invention includes bottom hole assemblies and drilling systems that include a pilot bit and a reamer bit. The pilot bit includes a plurality of cutting elements defining a cutting profile of the pilot bit, and the reamer bit includes a plurality of cutting elements defining a cutting profile of the reamer bit. Cutting elements in shoulder regions of the reamer bit have a greater average effective back rake angle than cutting elements in shoulder regions of the pilot bit.

Additional embodiments of the present invention include bottom hole assemblies and drilling systems that include a pilot bit and a reamer bit for enlarging a wellbore drilled by the pilot bit. The pilot bit includes a plurality of cutting elements defining a cutting profile of the pilot bit, and the reamer bit includes a plurality of cutting elements defining a cutting profile of the reamer bit. At least one cutting element of the plurality on the reamer bit has a side rake angle of about five degrees (5°) or more.

Further embodiments of the present invention include methods of drilling wellbores in subterranean formations. A pilot bit is selected having cutting elements in shoulder regions thereof that have a first effective back rake angle. A reamer bit is selected having cutting elements in shoulder regions thereof that have a second effective back rake angle greater than the first effective back rake angle. The pilot bit is used to drill a pilot bore, and the pilot bore is reamed with the reamer bit with drilling the pilot bore using the pilot bit.

Yet further embodiments include methods of forming drilling systems. A pilot bit is formed having a plurality of cutting elements in shoulder regions of a cutting profile of the pilot bit, and the cutting elements of the plurality are positioned on the pilot bit to have a first average effective back rake angle. A reamer bit is formed having a plurality of cutting elements in shoulder regions of a cutting profile of the reamer bit, and the cutting elements of the plurality are positioned on the reamer bit to have a second average effective back rake angle greater than the first average effective back rake angle. The pilot bit and the reamer bit are secured to a common drill string.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

The illustrations presented herein are not actual views of any particular drilling system, drilling tool assembly, or component of such an assembly, but are merely idealized representations which are employed to describe the present invention.

Figure 1:
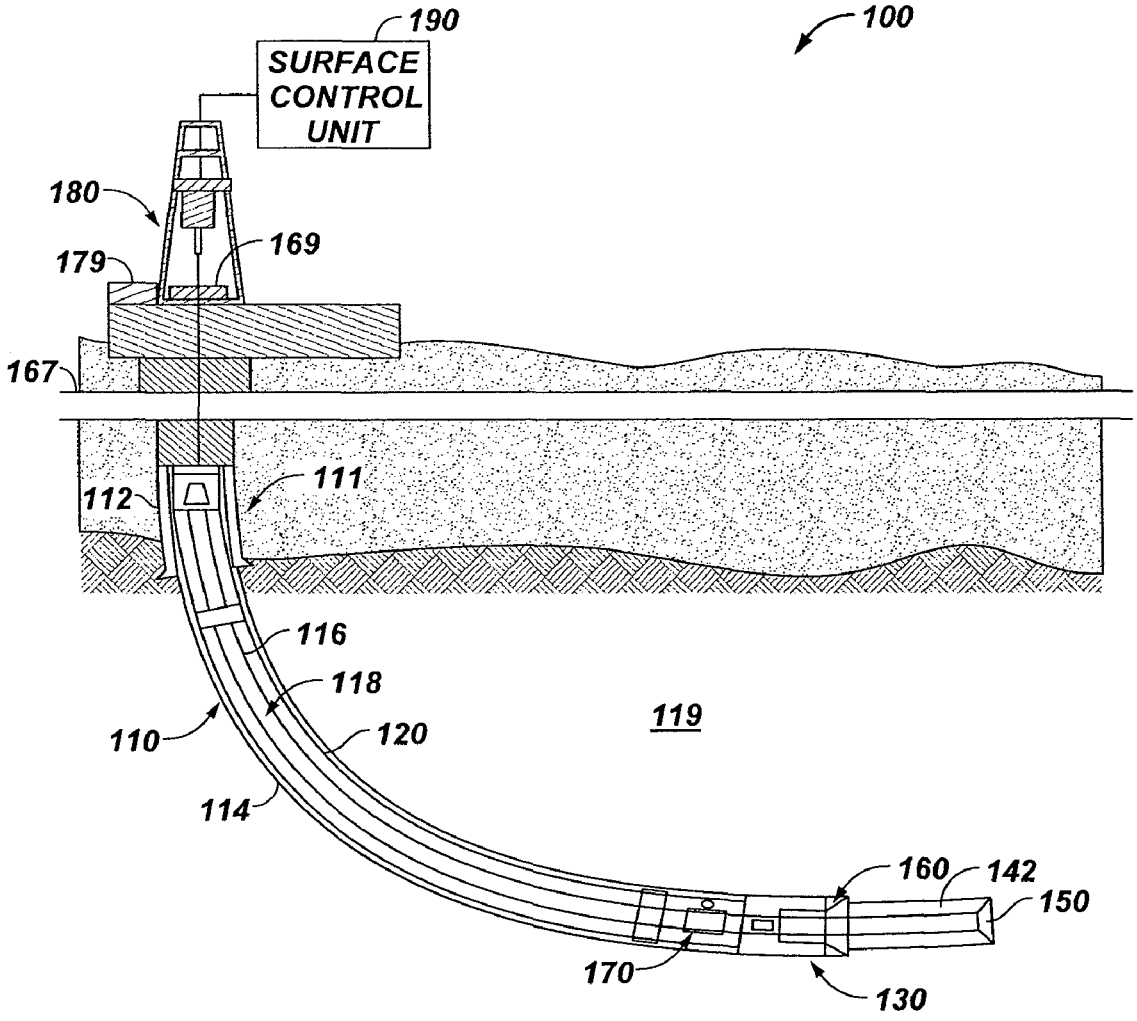
FIG. 1 is a schematic diagram of a wellbore system comprising a drill string that includes a reamer bit made according to one embodiment of the disclosure herein.

FIG. 1 is a schematic diagram of an exemplary drilling system 100 that may utilize the apparatus and methods disclosed herein for drilling wellbores. FIG. 1 shows a wellbore 110 that includes an upper section 111 with a casing 112 installed therein and a lower section 114 that is being drilled with a drill string 118. The drill string 118 includes a tubular member 116 that carries a drilling assembly 130 at its bottom end. The tubular member 116 may be made up by joining drill pipe sections or it may be coiled tubing. A first drill bit 150 (also referred to herein as the "pilot bit") is attached to the bottom end of the drilling assembly 130 for drilling a first smaller diameter borehole 142 in the formation 119. A second drill bit 160 (also referred to herein as the "reamer bit" or "reamer") is placed above or uphole of the pilot bit 150 in the drill string to enlarge the borehole 142 to a second larger diameter borehole 120. The terms wellbore and borehole are used herein as synonyms.

The drill string 118 extends to a rig 180 at the surface 167. The rig 180 shown is a land rig for ease of explanation. The apparatus and methods disclosed herein equally apply when an offshore rig is used for drilling under water. A rotary table 169 or a top drive (not shown) may be utilized to rotate the drill string 118 and the drilling assembly 130, and thus the pilot bit 150 and reamer bit 160 to respectively drill boreholes 142 and 120. The rig 180 also includes conventional devices, such as mechanisms to add additional sections to the tubular member 116 as the wellbore 110 is drilled. A surface control unit 190, which may be a computer-based unit, is placed at the surface for receiving and processing downhole data transmitted by the drilling assembly 130 and for controlling the operations of the various devices and sensors 170 in the drilling assembly 130. A drilling fluid from a source 179 thereof is pumped under pressure through the tubular member 116 that discharges at the bottom of the pilot bit 150 and returns to the surface via the annular space (also referred to as the "annulus") between the drill string 118 and an inside wall of the wellbore 110.

During operation, when the drill string 118 is rotated, both the pilot bit 150 and reamer bit 160 rotate. The pilot bit 150 drills the first smaller diameter borehole 142, while simultaneously the reamer bit 160 drills the second larger diameter borehole 120. The earth's subsurface may contain rock strata made up of different rock structures that can vary from soft formations to very hard formations. When the formation changes from a relatively harder formation to a relatively softer formation, the pilot bit 150 starts drilling through the soft formation while the reamer bit 160 is still drilling through the hard formation. Under such conditions, the reamer bit 160 may be subjected to substantially higher loads than the pilot bit 150, which may damage the reamer bit 160 or wear it out at a more rapid rate, while the pilot bit 150 remains in a sufficiently good operating condition to continue in service. This uneven wear occurs because the cutting elements on lower regions of commonly used reamer bits have relatively low effective back rake angles and, thus, high aggressiveness. Typically, the back rake angle of the reamer cutting elements is about 30 degrees (30°) or less, and the side rake angle is below (less than) 5 degrees (5°), which results in reamer bits that have relatively high aggressiveness. The reamer bit 160 shown in FIG. 1 is made according to the methods described herein to reduce load on certain regions of the reamer bit 160 to increase the life of the bit, as described in more detail in reference to FIGS. 2-5.

Figure 2:
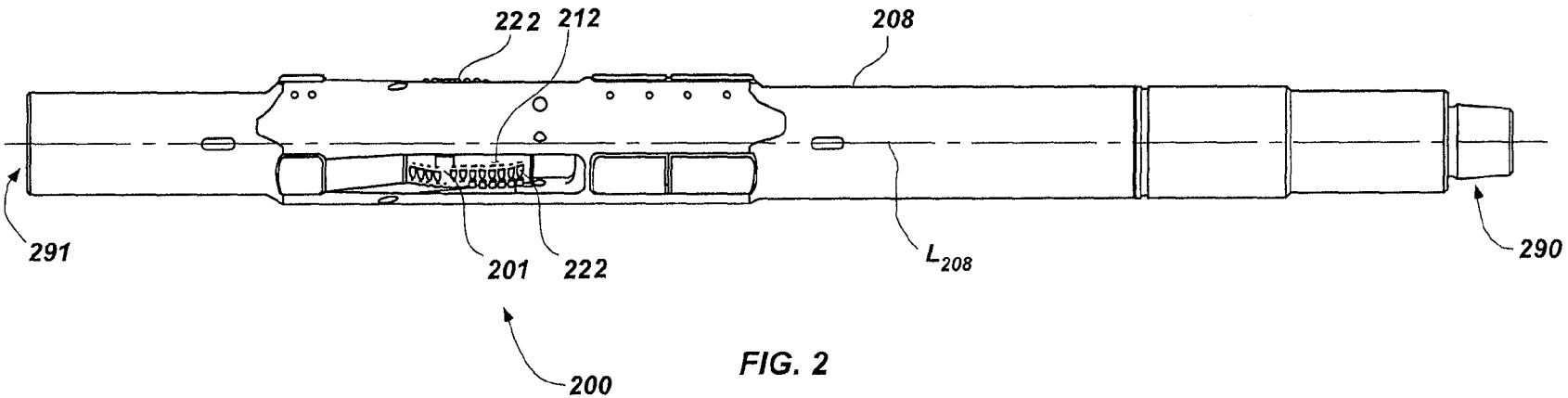
FIG. 2 is a is a side plan view of an embodiment of a reamer bit that may be used in the system of FIG. 1.

An embodiment of an expandable reamer bit 200 that may be used in the drilling system 100 of FIG. 1 is illustrated in FIG. 2. The expandable reamer bit 200 may include a generally cylindrical tubular body 208 having a longitudinal axis $L_{208}$. The tubular body 208 of the expandable reamer bit 200 may have a lower end 290 and an upper end 291. The terms "lower" and "upper," as used herein with reference to the ends 290, 291, refer to the typical positions of the ends 290, 291 relative to one another when the expandable reamer bit 200 is positioned within a wellbore. The lower end 290 of the tubular body 208 of the expandable reamer bit 200 may include a set of threads (e.g., a threaded male pin member) for connecting the lower end 290 to another section or component of the drill string 118 (FIG. 1). Similarly, the upper end 291 of the tubular body 208 of the expandable reamer bit 200 may include a set of threads (e.g., a threaded female box member) for connecting the upper end 291 to a section of a drill string or another component of the drill string 118 (FIG. 1).

The reamer bit 200 includes three sliding cutter blocks or blades 201 that are positioned circumferentially about the tubular body 208. Each blade 201 may comprise one or more rows of cutting elements 222 fixed to a body of the blade 201 at an outer surface 212 thereof. The blades 201 are movable between a retracted position, in which the blades 201 are retained within the tubular body 208, and an extended or expanded position in which the blades 201 project laterally from the tubular body 208. The cutting elements 222 on the blades 201 engage the walls of a subterranean formation within a wellbore when the blades 201 are in the extended position, but do not engage the walls of the formation when the blades 201 are in the retracted position. While the expandable reamer bit 200 includes three blades 201, it is contemplated that one, two or more than three blades 201 may be utilized. Moreover, while the blades 201 are symmetrically circumferentially positioned axial along the tubular body 208, the blades 201 may also be positioned circumferentially asymmetrically, and also may be positioned asymmetrically along the longitudinal axis $L_{208}$ in the direction of either end 290 and 291.

The construction and operation of the expandable reamer bit 200 shown in FIG. 2 is described in further detail in U.S. Patent Application Publication No. US 2008/0128175 A1 by Radford et al., which was published Jun. 5, 2008 and the disclosure of which is incorporated herein in its entirety by this reference.

Figure 3:
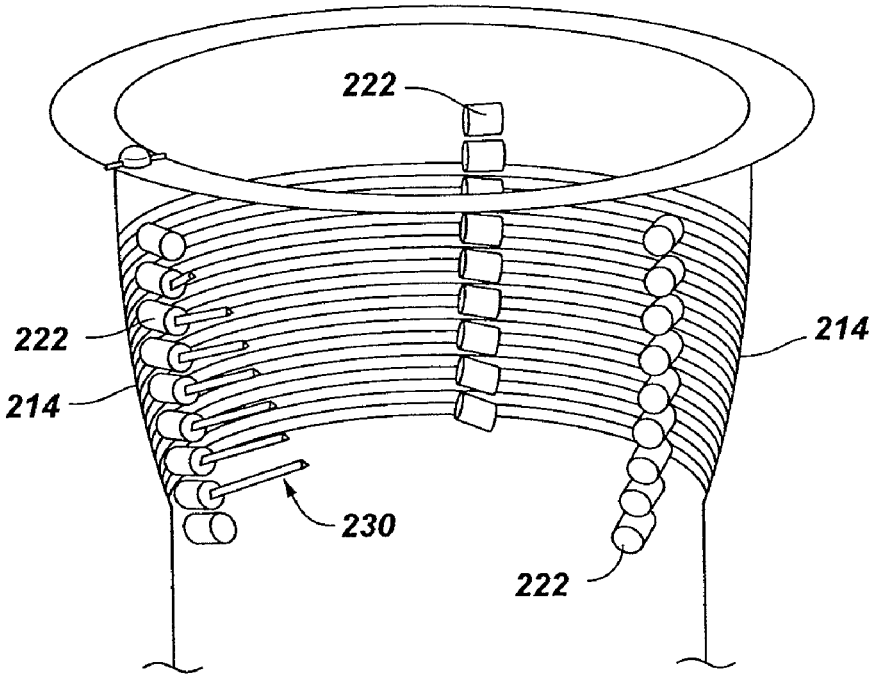
FIG. 3 is a graphic representation of a computer model used to calculate forces acting on cutting elements of a reamer bit like that of FIG. 2.

FIG. 3 is graphical representation of a computer model of cutting elements 222 of a reamer bit, like the expandable reamer bit 200 (FIG. 2). The cutting elements 222 define a cutter profile of the reamer bit 200, which is defined as the profile of a surface 214 cut upon rotation of the reamer bit 200 through one full revolution. The cutter profile of the reamer bit 200 is removed from the longitudinal axis of the reamer bit 200 (in contrast to the cutter profile of a pilot bit, which extends to the longitudinal axis of the pilot bit), and may be visualized by rotating each of the cutting elements 222 about a longitudinal axis of the reamer bit 200 into a common plane. Some of the cutting elements 222 may be redundant. In other words, two or more of the cutting elements 222 may be positioned and oriented on the reamer bit 200 to follow substantially the same helical path as the reamer bit 200 is rotated within a wellbore while applying weight to the reamer bit 200.

FIGS. 2 and 3 merely present one example of a configuration (e.g., locations and orientations) of the cutting elements 222 of the reamer bit 200. Any suitable configuration of cutting elements 222 and cutting profile may be employed in embodiments of the present invention.

During a drilling operation, each cutting element 222 may be subjected to a force applied on the cutter by the formation being cut. These forces acting on each cutting element 222 may be characterized by a force vector, which represents the magnitude and the direction of the net force acting on the cutting element 222 by the formation. As an example, force vectors 230 are shown for some of the cutting elements 222 in FIG. 3. The location and orientation of the cutting elements 222, the cutting profile, and the force vectors 230 shown in FIG. 3 are not to be construed as limitations.

Each cutting element 222 of the reamer bit 200 includes a front cutting face, which may be characterized by a back rake angle and side rake angle. The definition of the "back rake angle" is set forth below with reference to FIG. 7, and the definition of "side rake angle" is set forth below with reference to FIG. 8.

Figure 7:
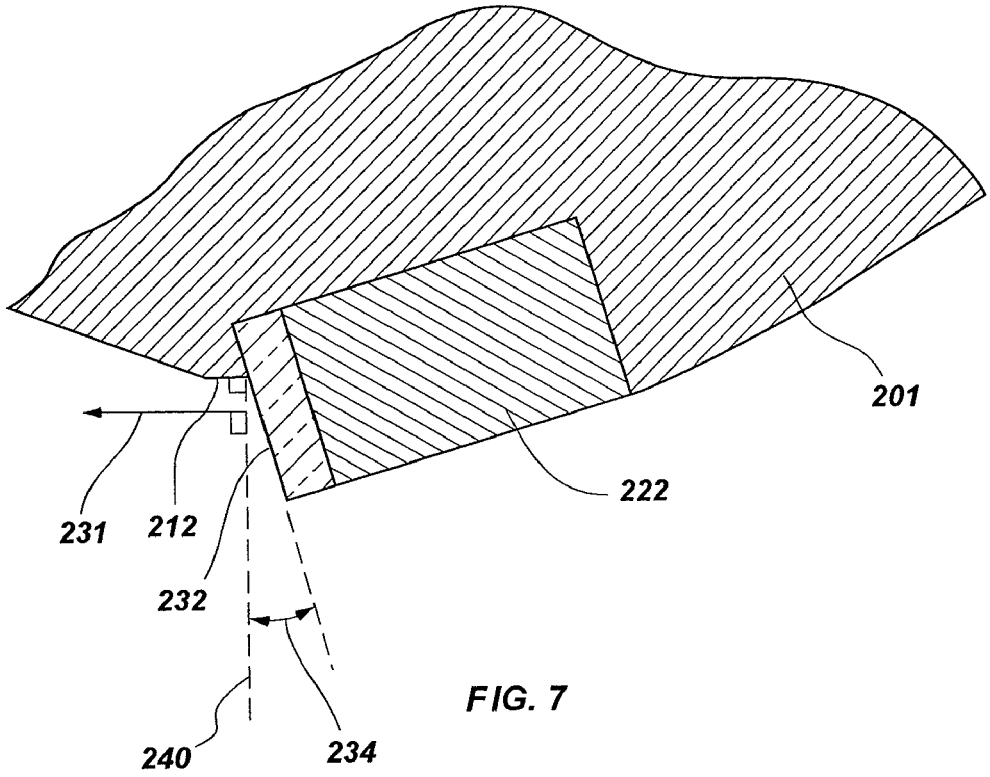
FIG. 7 illustrates the back rake angle of a cutting element on a reamer bit like that of FIG. 2.

FIG. 7 is a cross-sectional view of a cutting element 222 positioned on the blade 201 of the reamer bit 200 (FIG. 2). The cutting direction is represented by the directional arrow 231. The cutting element 222 may be mounted on the blade 201 in an orientation such that the cutting face 232 of the cutting element 222 is oriented at a back rake angle 234 with respect to a dashed line 240. The dashed line 240 may be defined as a line that extends (in the plane of FIG. 7) radially outward from the outer surface 212 of the blade 201 of the reamer bit 200 in a direction substantially perpendicular thereto at that location. Additionally or alternatively, the dashed line 240 may be defined as a line that extends (in the plane of FIG. 7) radially outward from the outer surface 212 of the reamer bit 200 in a direction substantially perpendicular to the cutting direction as indicated by directional arrow 231. The back rake angle 234 may be measured relative to the dashed line 240, with positive angles being measured in the counter-clockwise direction and negative angles being measured in the clockwise direction.

Figure 8:
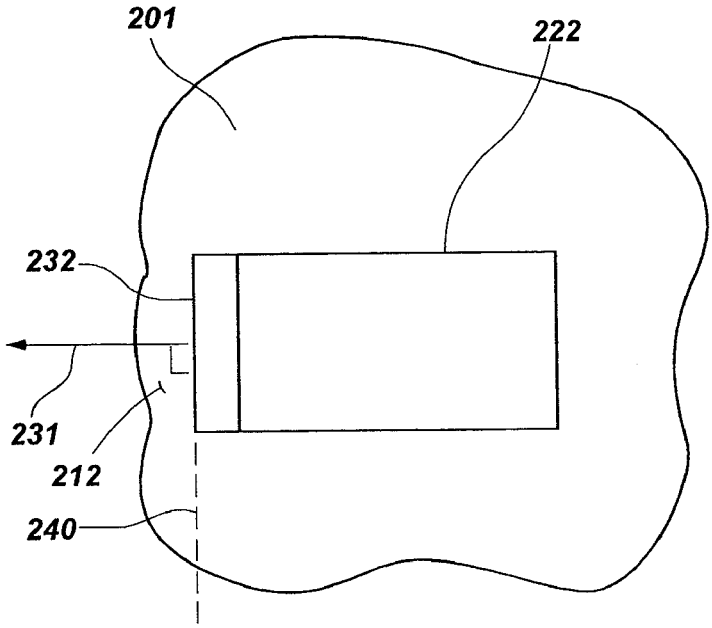
FIGS. 8 through 10 illustrate side rake angles of cutting elements on a reamer bit like that of FIG. 2.
Figure 9:
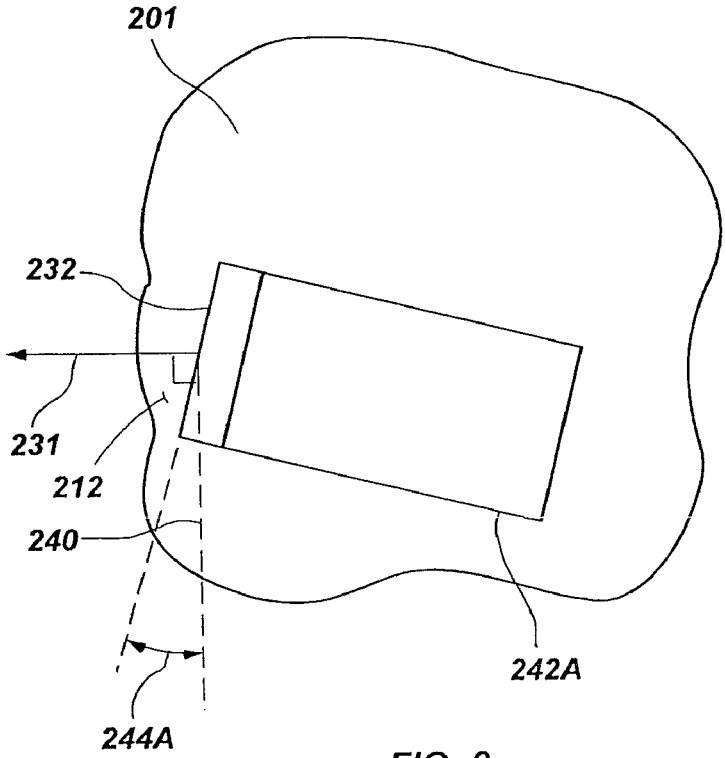
Figure 10:
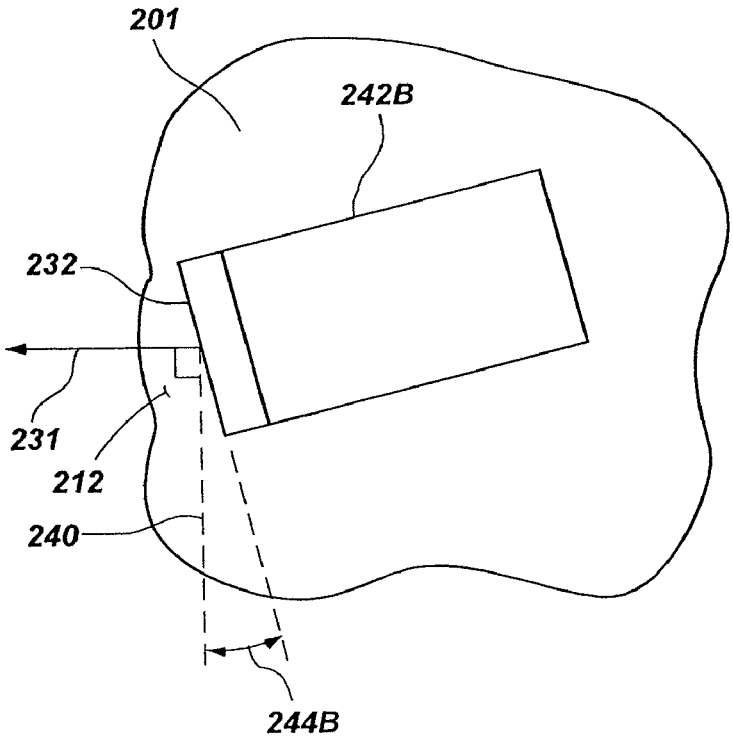

FIG. 8 is an enlarged partial side view of a cutting element 222 mounted on the blade 201 of the reamer bit 200 (FIG. 2). The cutting direction is represented by the directional arrow 231. The cutting element 222 may be mounted on the blade 201 in an orientation such that the cutting face 232 of the cutting element 222 is oriented substantially perpendicular to the cutting direction as indicated by directional arrow 231. In such a configuration, the cutting element 222 does not exhibit a side rake angle. The side rake angle of the cutting element 222 may be defined as the angle between a dashed line 240, which is oriented substantially perpendicular to the cutting direction as indicated by directional arrow 231 and tangent to the outer surface 212 of the blade 201 proximate the cutting face 232, with positive angles being measured in the counter-clockwise direction and negative angles being measured in the clockwise direction. For example, a cutting element 242A may be mounted in the orientation shown in FIG. 9. In this configuration, the cutting element 242A may have a negative side rake angle 244A. Furthermore, a cutting element 242B may be mounted in the orientation shown in FIG. 10. In this configuration, the cutting element 242B may have a positive side rake angle 244B.

Figure 4:
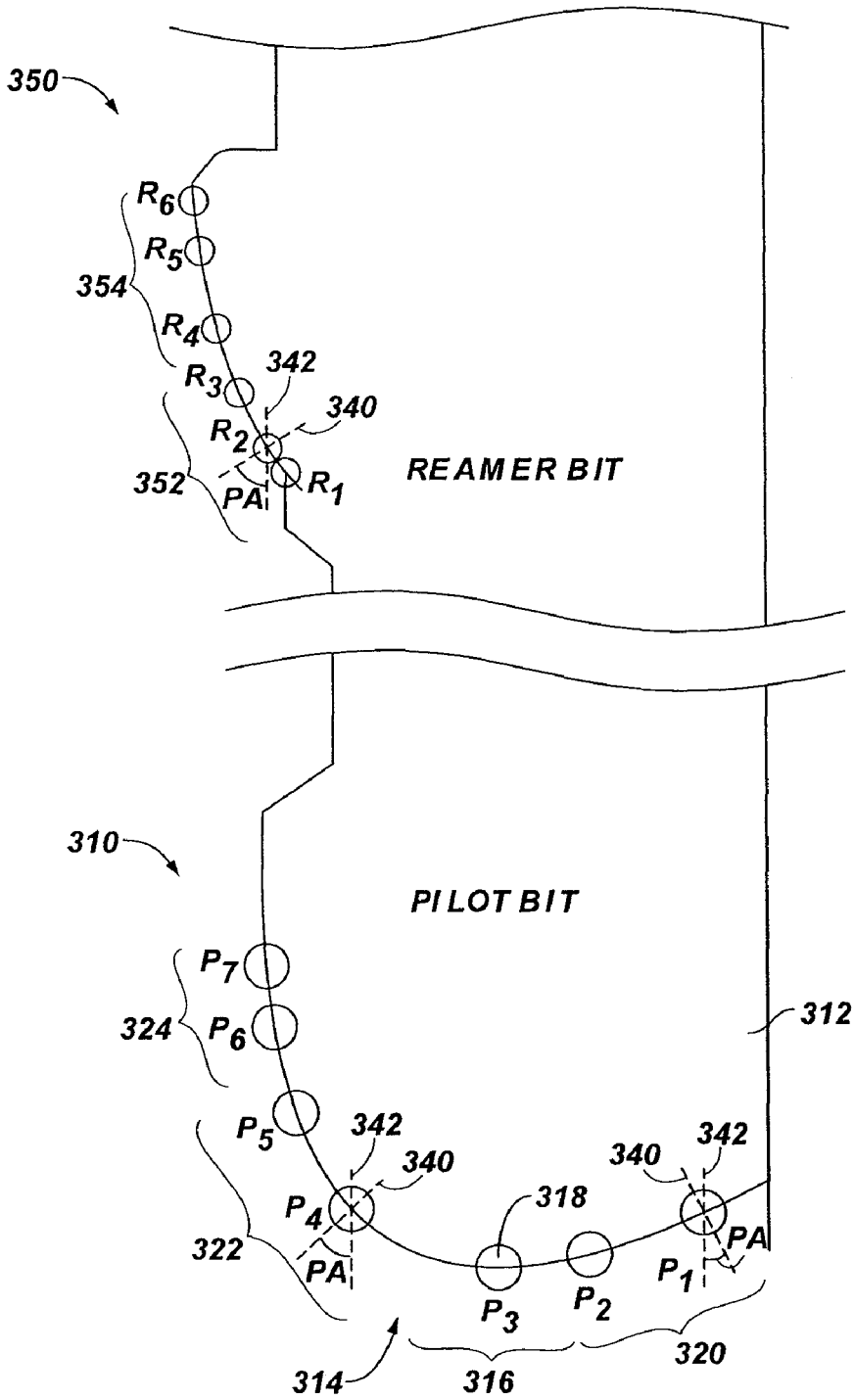
FIG. 4 is a schematic diagram showing a relationship between cutting elements on a pilot bit and cutting elements on a reamer bit according to one embodiment of the disclosure herein.

Aggressiveness of a cutting element 222 depends upon the effective back rake angle of the cutting element 222. Greater effective back rake lowers the aggressiveness. Overall aggressiveness of a region of a bit is based on the overall or average effective back rake angle of the cutting elements in that region. Effective back rake angle may be defined by, and calculated from, Equation 1:

$$\text{Effective } BKR = BKR\cos(PA) + SRK\sin(PA),$$

wherein BKR is the back rake of the cutting element, SRK is the side rake of the cutting element, and PA is the profile angle of the cutting element, the profile angle being defined as the angle between a line that extends normal to the surface of the blade at the point at which the cutting element is located and passes through the center of the cutting element, and a line extending through the center of the cutting element parallel to the longitudinal axis of the bit (see FIG. 4). The orientation of the cutting elements is, however, selected in accordance with methods and features described in reference to FIGS. 4 and 5.

FIG. 4 shows a simplified sketch of a reamer bit 350 made according to one embodiment of the disclosure and a pilot bit 310 that may be used with the reamer bit 350. FIG. 4 illustrates a cutting element profile of some cutting elements on each of the reamer bit 350 and the pilot bit 310. The pilot bit 310 is shown to include a bit body 312, having a plurality of blades. One blade 314 and the profile thereof are shown in FIG. 4. The profile of the blade 314 includes a nose region 316 proximate the most bottom point 318 of the pilot bit 310, a cone region 320, a lower shoulder region 322, and an upper shoulder region 324. The cone region 320 is shown to include cutting elements $P_1$ and $P_2$, the nose region 316 is shown to include cutting element $P_3$, the lower shoulder region 322 is shown to include cutting elements $P_4$ and $P_5$, and the upper shoulder region 324 is shown to include cutting elements $P_6$ and $P_7$.

Each cutting element has a profile angle PA defined as the angle between a dashed line 340 that extends normal to the surface of the blade 314 at the point at which the cutting element is located and passes through the center of the cutting element, and a dashed line 342 extending through the center of the cutting element parallel to the longitudinal axis of the bit. For example, the profile angle of the cutting element $P_4$ may be about 45 degrees (45°), the profile angle of the cutting element $P_5$ may be about 60 degrees (60°), and the profile angle of the cutting element $P_7$ may be about 80 degrees (80°).

The reamer bit 350 is shown to include cutting elements $R_1$-$R_3$ on a lower shoulder region 352 of the reamer bit 350, and cutting elements $R_4$-$R_6$ on an upper shoulder region 354 of the reamer bit 350.

The numbers of cutting elements in each of the regions of the profiles shown in FIG. 4 are arbitrarily selected herein for the purpose of illustration and ease of explanation only. In practice, the numbers of cutting elements in each of the regions of the profiles, the locations of the cutting elements, and their orientations are selected based upon various design criteria and on the intended use of the bits. The design criteria may include the cutting elements design of a pilot bit that is intended for use with the reamer bit.

The cone region 320 of the pilot bit 310 may be defined as the region of the pilot bit 310 extending from the cutting element radially closest to the longitudinal axis of the pilot bit 310 to the last cutting element having a profile angle PA about −10 degrees (−10°) or less. The nose region 316 of the pilot bit 310 may be defined as the region of the pilot bit 310 extending from the first cutting element having a profile angle PA greater than about −10 degrees (−10°) to the last cutting element having a profile angle PA of about 10 degrees (10°) or less. The lower shoulder region 322 of the pilot bit 310 may be defined as the region of the pilot bit 310 extending from the first cutting element having a profile angle PA greater than about 10 degrees (10°) to the last cutting element having a profile angle PA of about 79 degrees (79°) or less. The upper shoulder region 324 of the pilot bit 310 may be defined as the region of the pilot bit 310 extending from the first cutting element having a profile angle PA greater than about 79 degrees (79°) to the first cutting element having a profile angle PA of about 90 degrees (90°).

The lower shoulder region 352 of the reamer bit 350 may be defined as the region of the reamer bit 350 extending from the first cutting element having a profile angle PA of at least about 10 degrees (10°) to the last cutting element having a profile angle PA of about 79 degrees (79°) or less. The upper shoulder region 354 of the reamer bit 350 may be defined as the region of the reamer bit 350 extending from the first cutting element having a profile angle PA greater than about 79 degrees (79°) to the first cutting element having a profile angle PA of about 90 degrees (90°).

Figures 5, 6:
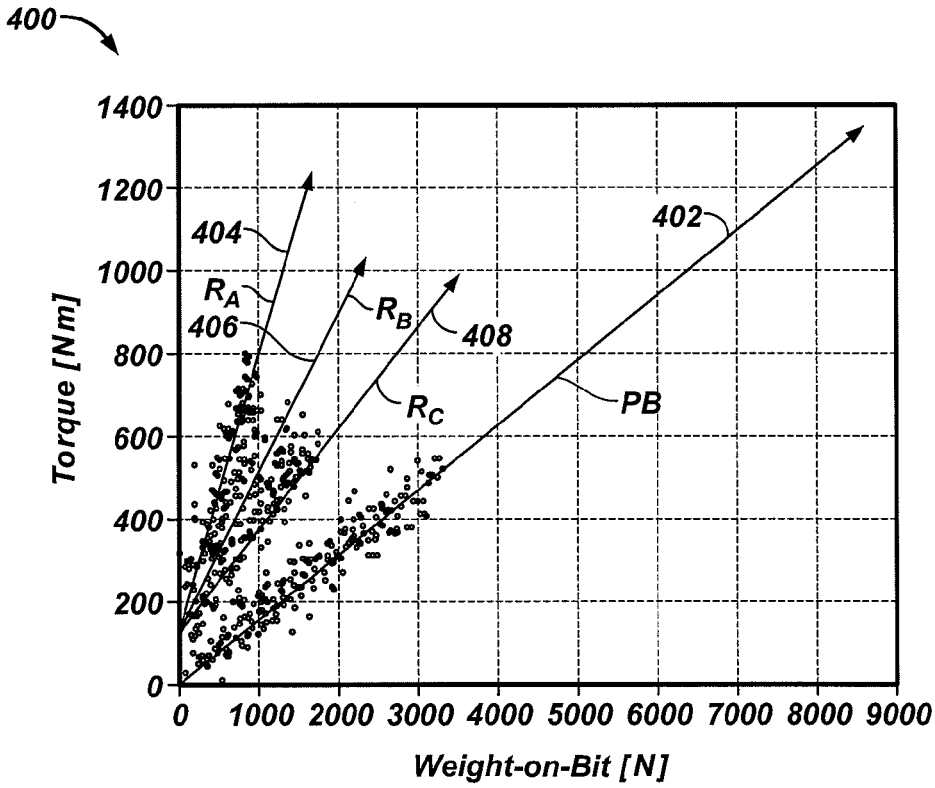
FIG. 5 is a graph showing a relationship between the weight and torque for a pilot bit and reamer bits according to embodiments of the disclosure.
FIG. 6 is a table of the profile angle, back rake angle, side rake angle, and effective back rake angle of cutting elements on a pilot bit and cutting elements on a reamer bit according to one embodiment of the disclosure herein.

Referring to FIG. 6, Table 1 shows an example of the profile angle PA, back rake angle BRK and side rake angle SRK for each of the cutting elements $P_1$-$P_7$ of the pilot bit 310 and cutting elements $R_1$-$R_6$ of the reamer bit 350. The effective back rake angle ("EFF. BRK"), calculated using Equation 1 above, for each cutting element is shown in the last column of Table 1. As noted earlier, the higher the effective back rake of a cutting element, the lower the aggressiveness of the cutting element. In the example shown in Table 1, the overall (i.e., average) effective back rake of the cutting elements in the upper shoulder region 324 (cutting elements $P_6$ and $P_7$) of the pilot bit 310 is substantially less than the overall (i.e., average) effective back rake of the cutting elements in the lower shoulder region 322 (cutting elements $P_4$ and $P_5$). Thus, the upper shoulder region 324 of the pilot bit 310 is more aggressive than the lower shoulder region 322. In typical PDC pilot bits, the back rake angles of the cutting elements in the various regions of the profile are often the same and less than twenty degrees (20°). The side rake angles of the cutting elements in the various regions of the profile are also often the same and between zero degrees (0°) and five degrees (5°). The side rake angles of cutting elements employed on reamer bits are often zero degrees (0°). Such low values of the side rake angles, and the orientation of the cutting elements at a uniform back rake angle between about 15 degrees (15°) and about 20 degrees (20°), provide for relatively low effective back rake angles and substantially high aggressiveness for the reamer bit regions. Thus, previously employed combinations of pilot and reamer bits provide drill bits that have uneven load distribution between the reamer bit 350 and pilot bit 310 during drilling of a wellbore 118 (FIG. 1.), which may damage the reamer bit 350 when the pilot bit 310 is drilling in a soft formation while the reamer bit 350 is still drilling in a hard formation. This is typically due to the fact that, under such drilling conditions, the lower shoulder region 352 of the reamer bit 350 is under a great load, which can cause damage to the reamer bit 350 or wear it out quickly while the pilot bit 310 is still in an acceptable condition.

Table 1 (FIG. 6) further shows an example of selecting side rake angles of the cutting elements of the reamer bit 350 to control the aggressiveness of the reamer bit 350 in accordance with some embodiments of the present invention. As shown in Table 1, the side rake angles of the cutting elements $R_1$-$R_6$ on the reamer bit 350 vary from 25 degrees (25°) to 5 degrees (5°). In additional embodiments, the side rake angles of the cutting elements $R_1$-$R_6$ on the reamer bit 350 may be uniform (i.e., at least substantially equal) and about 5 degrees (5°) or more.

The average effective back rake of the cutting elements $R_1$-$R_3$ in the lower shoulder region 352 of the reamer bit 350 is substantially greater than the average effective back rake of the cutting elements $R_4$-$R_6$ in the upper shoulder region 354 of the reamer bit 350. The average effective back rake of the cutting elements $R_1$-$R_3$ in the lower shoulder region 352 is 23.8 degrees (23.8°), while the average effective back rake of the cutting elements $R_4$-$R_6$ in the upper shoulder region 354 is 7.9 degrees (7.9°). Thus, in the embodiment of FIG. 4, the average effective back rake of the cutting elements in the lower shoulder region 352 is about three (3) times the average effective back rake of the cutting elements in the upper shoulder region 354. In additional embodiments of the present invention, the average effective back rake of the cutting elements in the lower shoulder region 352 may be about one and one-half (1.5) times or more of the average effective back rake of the cutting elements in the upper shoulder region 354. In yet further embodiments, the average effective back rake of the cutting elements in the lower shoulder region 352 may be about two (2) times or more of the average effective back rake of the cutting elements in the upper shoulder region 354, or even more than three (3) times the average effective back rake of the cutting elements in the upper shoulder region 354.

Furthermore, the average effective back rake of the cutting elements $R_1$-$R_3$ in the lower shoulder region 352 of the reamer bit 350 is substantially greater than the average effective back rake of the cutting elements $P_4$ and $P_5$ in the lower shoulder region 322 of the pilot bit 310. The average effective back rake of the cutting elements $R_1$-$R_3$ in the lower shoulder region 352 of the reamer bit 350 is 23.8 degrees (23.8°), while the average effective back rake of the cutting elements $P_4$ and $P_5$ in the lower shoulder region 322 of the pilot bit 310 is 11.4 degrees (11.4°). Thus, in the embodiment of FIG. 4, the average effective back rake of the cutting elements in the lower shoulder region 352 of the reamer bit 350 is about two (2) times the average effective back rake of the cutting elements in the lower shoulder region 322 of the pilot bit 310. In additional embodiments of the present invention, the average effective back rake of the cutting elements in the lower shoulder region 352 of the reamer bit 350 may be about one and one-half (1.5) times or more of the average effective back rake of the cutting elements in the lower shoulder region 322 of the pilot bit 310. In yet further embodiments, the average effective back rake of the cutting elements in the lower shoulder region 352 of the reamer bit 350 may be greater than about two (2) times the average effective back rake of the cutting elements in the lower shoulder region 322 of the pilot bit 310, or even about three (3) times or more of the average effective back rake of the cutting elements in the lower shoulder region 322 of the pilot bit 310.

Further still, the average effective back rake of the cutting elements $R_4$-$R_6$ in the upper shoulder region 354 of the reamer bit 350 is substantially greater than the average effective back rake of the cutting elements $P_6$ and $P_7$ in the upper shoulder region 324 of the pilot bit 310. The average effective back rake of the cutting elements $R_4$-$R_6$ in the upper shoulder region 354 of the reamer bit 350 is 7.9 degrees (7.9°), while the average effective back rake of the cutting elements $P_6$ and $P_7$ in the upper shoulder region 324 of the pilot bit 310 is 4.3 degrees (4.3°). Thus, in the embodiment of FIG. 4, the average effective back rake of the cutting elements in the upper shoulder region 354 of the reamer bit 350 is about 1.8 times the average effective back rake of the cutting elements in the upper shoulder region 324 of the pilot bit 310. In additional embodiments of the present invention, the average effective back rake of the cutting elements in the upper shoulder region 354 of the reamer bit 350 may be about one and one-half (1.5) times or more of the average effective back rake of the cutting elements in the upper shoulder region 324 of the pilot bit 310. In yet further embodiments, the average effective back rake of the cutting elements in the upper shoulder region 354 of the reamer bit 350 may be greater than about 1.8 times (e.g., about two (2) times) the average effective back rake of the cutting elements in the upper shoulder region 324 of the pilot bit 310, or even about three (3) times or more of the average effective back rake of the cutting elements in the upper shoulder region 324 of the pilot bit 310.

Overall, the average effective back rake of the cutting elements in the shoulder regions 352, 354 of the reamer bit 350 may be substantially greater than the average effective back rake of the cutting elements in the shoulder regions 322, 324 of the pilot bit 310. For example, the average effective back rake of the cutting elements $R_1$-$R_6$ in the shoulder regions 352, 354 of the reamer bit 350 is 15.9 degrees (15.9°), while the average effective back rake of the cutting elements $P_4$-$P_7$ in the shoulder regions 322, 324 of the pilot bit 310 is 7.9 degrees (7.9°). Thus, in the embodiment of FIG. 4, the average effective back rake of the cutting elements in the shoulder regions 352, 354 of the reamer bit 350 is about two (2) times the average effective back rake of the cutting elements in the shoulder regions 322, 324 of the pilot bit 310. In additional embodiments of the present invention, the average effective back rake of the cutting elements in the shoulder regions 352, 354 of the reamer bit 350 may be about one and one-half (1.5) times the average effective back rake of the cutting elements in the shoulder regions 322, 324 of the pilot bit 310. In yet further embodiments, the average effective back rake of the cutting elements in the shoulder regions 352, 354 of the reamer bit 350 may be about greater than about two (2) times the average effective back rake of the cutting elements in the shoulder regions 322, 324 of the pilot bit 310, or even about three (3) times or more of the average effective back rake of the cutting elements in the shoulder regions 322, 324 of the pilot bit 310.

It will be appreciated that the profile angles of the cutting elements $P_1$-$P_7$ on the pilot bit 310 are capable of varying over a relatively wide range of angles, while the cutting elements $R_1$-$R_6$ on the reamer bit 350 are capable of varying over a relatively narrow range of angles. Thus, if it is desired to reduce the average effective back rake of cutting elements $R_1$-$R_6$ on the reamer bit 350, and, hence, the aggressiveness of the reamer bit 350, the profile angle may not be a readily alterable characteristic of the cutting elements $R_1$-$R_6$ of the reamer bit 350. Furthermore, it is noted that the sine of an angle is relatively greater than the cosine of the angle for angles between forty-five degrees (45°) and ninety degrees, (90°) while the cosine of an angle is relatively greater than the sine of the angle for angles between zero degrees (0°) and forty-five degrees (45°). Thus, it may be appreciated upon consideration of Equation 1 above that, for angles between forty-five degrees (45°) and ninety degrees (90°), a greater increase in the effective back rake angle may be obtained by varying the side rake angle (which is factored by the sine of the profile angle) than may be obtained by varying the back rake angle (which is factored by the cosine of the profile angle) by the same degree.

Thus, in some embodiments, it may be desirable to alter the effective back rake of cutting elements of the reamer bit 350 by varying the side rake angles of the cutting elements of the reamer bit 350. For example, one or more cutting elements of the reamer bit 350 may have a side rake angle of about five degrees (5°) or more, as shown in Table 1 (FIG. 6). Cutting elements in the lower shoulder region 352 of the cutting profile of the reamer bit 350 may have a first average side rake angle, and cutting elements of the reamer bit 350 in the upper shoulder region 354 of the cutting profile of the reamer bit 350 may have a second average side rake angle that is less than the first average side rake angle. As shown in Table 1 (FIG. 6), the average side rake angle of cutting elements in the lower shoulder region 352 may be greater than about twelve degrees (12°) (e.g., about fifteen degrees (15°) or more), and the average side rake angle of cutting elements in the upper shoulder region 354 may be less than about twelve degrees (12°) (e.g., about ten degrees (10°) or less). In the particular non-limiting example shown in Table 1 (FIG. 6), the cutting elements in the lower shoulder region 352 have an average side rake angle of twenty degrees (20°), and the cutting elements in the upper shoulder region 354 have an average side rake angle of six and seven tenths degrees (6.7°). Thus, in some embodiments of the reamer bit 350, the cutting elements in the lower shoulder region 352 of the cutting profile have an average side rake angle of at least about fifteen degrees (15°). As also shown in Table 1 (FIG. 6), in some embodiments, cutting elements of the pilot bit 310 (e.g., cutting elements in shoulder regions 322, 324 of the pilot bit 310, or cutting elements in all regions of the pilot bit 310) may have an average side rake angle of about ten degrees (10°) or less, or even about five degrees (5°) or less (e.g., about three degrees (3°)).

In the configurations described above, the aggressiveness of the lower shoulder region 352 of the reamer bit 350 is substantially less than the aggressiveness of the upper shoulder region 354 of the reamer bit 350. Furthermore, in the example of Table 1, the average effective back rake of the cutting elements in the lower shoulder region 352 of the reamer bit 350 is substantially greater than the average effective back rake of cutting element in each of the regions of the pilot bit 310. Therefore, during drilling of a wellbore with the pilot bit 310 and the reamer bit 350, the lower shoulder region 352 of the reamer bit 350 will be less aggressive than the upper shoulder region 354 of the reamer bit 350, and less aggressive than each of the upper shoulder region 324 and the lower shoulder region 322 of the pilot bit 310, thereby reducing the chances of rapid wear and breakdown when the pilot bit 310 is drilling into a soft formation while the reamer bit 350 is drilling into a hard formation. Table 1 merely shows one example of a method that may be used to alter the effective back rake, and hence, the aggressiveness of the cutting elements of a reamer bit. The effective back rake angles of the cutting elements on the reamer bit, and hence, the aggressiveness of the reamer bit, may be selectively tailored (e.g., reduced) by choosing a particular combination of side rake angles and back rake angles for the cutting elements of the reamer bit. Furthermore, the average effective back rake of the cutting elements of the reamer bit may be selectively tailored in conjunction with the average effective back rake of the cutting elements in one or more regions of a pilot bit with which the reamer bit is intended for use. Thus, the reamer bit aggressiveness may be matched with (e.g., reduced relative to) the pilot bit aggressiveness by appropriately selecting the side rake angles and back rake angles of cutting elements on the reamer bit and the pilot bit. Thus, in some embodiments, an ideal distribution of the weight-on-bit may be applied between the reamer bit and the pilot bit.

FIG. 5 shows a graph 400 of the relationship of torque and weight-on-bit of a pilot bit $P_B$ (which is similar to pilot bit 310 (FIG. 4)) and the effect of altering side rake angles (and, hence, the effective back rake angles) for reamer bits $R_A$, $R_B$ and $R_C$. Curve 402 shows that the behavior of the pilot bit $P_B$ is substantially normal (i.e., the torque increases linearly at a steady rate with increasing weight). The cutting elements of the reamer bit $R_A$ have the same back rake angle, and each cutting element has a side rake angle of about three degrees (3°). Curve 404 indicates that the torque on the reamer bit $R_A$ increases with increasing weight at a much higher rate than does the torque on the pilot bit $P_B$. Thus, if the reamer bit $R_A$ is used in conjunction with the pilot bit $P_B$, the load distribution between the reamer bit $R_A$ and the pilot bit $P_B$ would be relatively uneven, with much higher torque being applied to the reamer bit $R_A$, which may result in the reamer bit $R_A$ wearing out relatively quickly. The cutting elements of the reamer bit $R_B$ have been changed to increase the average effective back rake of the cutting elements in the lower shoulder region of the reamer bit $R_B$. Curve 406 indicates that, if the reamer bit $R_B$ is used in conjunction with the pilot bit $P_B$ instead of the reamer bit $R_A$, an improved load distribution would be provided between the reamer bit $R_B$ and the pilot bit $P_B$, as compared to the distribution of the load between the reamer bit $R_A$ and the pilot bit $P_B$. In other words, the torque on the reamer bit $R_B$ would be less for a given weight than would the torque on the reamer bit $R_A$ for that weight. The cutting elements of the reamer bit $R_C$ exhibit a greater average effective back rake than do the cutting elements of the reamer bit $R_B$ due to the fact that the average side rake angle of the cutting elements of the reamer bit $R_C$ is greater than that of the cutting elements of the reamer bit $R_B$. Curve 408 indicates that, if the reamer bit $R_C$ is used in conjunction with the pilot bit $P_B$ instead of the reamer bit $R_B$ or the reamer bit $R_A$, a further improved load distribution would be provided between the reamer bit $R_C$ and the pilot bit $P_B$. In other words, the torque on the reamer bit $R_C$ would be less for a given weight than would the torque on either the reamer bit $R_A$ or the reamer bit $R_B$ for that weight.

Thus, in accordance with embodiments of the present invention, as described hereinabove, the relationship between the average effective back rake of cutting elements on a reamer bit and the average effective back rake of cutting elements on a pilot bit may be designed and configured to distribute a weight between the reamer bit and the pilot bit in such a manner as to improve the distribution of loads between the reamer bit and the pilot bit and improve the life of the drilling system.

Embodiments of the present invention also include methods of forming reamer bits and drilling systems including reamer bits and pilot bits as previously described herein, as well as methods of using reamer bits and drilling systems including reamer bits and pilot bits as previously described herein.

By way of example and not limitation, to drill a wellbore in a subterranean formation, a pilot bit may be selected having cutting elements in shoulder regions thereof that have a first effective back rake angle. A reamer bit may be selected having cutting elements in shoulder regions thereof that have a second effective back rake angle greater than the first effective back rake angle. The pilot bit then may be used to drill a pilot bore, and the pilot bore may be reamed with the reamer bit while drilling the pilot bore using the pilot bit. Such a method may be adapted to accommodate any of the various structures and features described hereinabove in relation to the various embodiments of reamer bits and drilling systems of the present invention.

As another non-limiting example, a drilling system may be formed by forming a pilot bit having a plurality of cutting elements in shoulder regions of a cutting profile of the pilot bit, forming a reamer bit having a plurality of cutting elements in shoulder regions of a cutting profile of the reamer bit, and securing the pilot bit and the reamer bit to a common drill string. The cutting elements of the plurality on the pilot bit are positioned to have a first average effective back rake angle, and the cutting elements of the plurality on the reamer bit are positioned to have a second average effective back rake angle greater than the first average effective back rake angle. Again, such a method may be adapted to accommodate any of the various structures and features described hereinabove in relation to the various embodiments of reamer bits and drilling systems of the present invention.

The foregoing description is directed to particular embodiments for the purpose of illustration and explanation. It will be apparent, however, to one skilled in the art that many modifications and changes to the embodiments set forth above are possible without departing from the scope and the spirit of the embodiments disclosed herein. It is intended that the following claims be interpreted to embrace all such modifications and changes.

What is claimed is:

1. A reamer bit comprising:

a generally tubular body extending between a first end and a second end, the generally tubular body configured for attachment to a drill string; and a plurality of cutting elements disposed on one or more blades carried by the generally tubular body between the first end and the second end thereof, the cutting elements of the plurality defining a cutting profile spaced radially apart from a longitudinal axis of the reamer bit and longitudinally apart from the first end and the second end of the generally tubular body when the one or more blades are in an operable position;

wherein at least one cutting element of the plurality has an effective back rake angle of about fifteen degrees (15°) or more, wherein at least one cutting element of the plurality has a side rake angle of about five degrees (5°) or more, and wherein the plurality of cutting elements comprises all the cutting elements carried by the reamer bit between the first end and the second end.

2. A reamer bit comprising:

a generally tubular body extending between a first end and a second end, the generally tubular body configured for attachment to a drill string; and a plurality of cutting elements carried by the generally tubular body between the first end and the second end thereof, the cutting elements of the plurality defining a cutting profile spaced radially apart from a longitudinal axis of the reamer bit when the one or more blades are in an operable position, wherein at least one cutting element of the plurality has an effective back rake angle of about fifteen degrees (15°) or more;

wherein the cutting profile of the reamer bit includes a lower shoulder region and an upper shoulder region, cutting elements of the plurality in the lower shoulder region having a first average effective back rake angle that is greater than a second average effective back rake angle of cutting elements of the plurality in the upper shoulder region.

3. The reamer bit of claim 2, wherein the cutting elements of the plurality in the lower shoulder region have a first average side rake angle that is greater than a second average side rake angle of the cutting elements in the upper shoulder region.

4. The reamer bit of claim 3, wherein the first average side rake angle is greater than about fifteen degrees (15°), and the second average side rake angle is less than about ten degrees (10°).

5. The reamer bit of claim 2, wherein the first average effective back rake angle is at least about one and one-half (1.5) times the second average effective back rake angle.

6. The reamer bit of claim 5, wherein the first average effective back rake angle is greater than about twenty degrees (20°), and the second average effective back rake angle is less than about fifteen degrees (15°).

7. The reamer bit of claim 5, wherein the first average effective back rake angle is at least about two (2) times the second average effective back rake angle.

8. The reamer bit of claim 7, wherein the first average effective back rake angle is greater than about twenty degrees (20°), and the second average effective back rake angle is less than about ten degrees (10°).

9. A reamer bit comprising:

a generally tubular body extending between a first end and a second end, the generally tubular body configured for attachment to a drill string; and a plurality of cutting elements disposed on one or more blades carried by the generally tubular body between the first end and the second end thereof, the cutting elements of the plurality defining a cutting profile spaced radially apart from a longitudinal axis of the reamer bit and longitudinally apart from the first end and the second end of the generally tubular body when the one or more blades are in an operable position, at least one cutting element of the plurality of cutting elements having a side rake angle of about five degrees (5°) or more;

wherein the plurality of cutting elements comprises all the cutting elements carried by the reamer bit between the first end and the second end.

10. A reamer bit comprising:

a generally tubular body extending between a first end and a second end, the generally tubular body configured for attachment to a drill string; and a plurality of cutting elements disposed on one or more blades carried by the generally tubular body between the first end and the second end thereof, the cutting elements of the plurality defining a cutting profile spaced radially apart from a longitudinal axis of the reamer bit when the one or more blades are in an operable position, at least one cutting element of the plurality of cutting elements having a side rake angle of about five degrees (5°) or more wherein cutting elements of the plurality in a lower shoulder region of the cutting profile have a first average side rake angle, and wherein cutting elements of the plurality in an upper shoulder region of the cutting profile have a second average side rake angle less than the first average side rake angle.

11. The reamer bit of claim 10, wherein the first average side rake angle is greater than about twelve degrees (12°), and the second average side rake angle is less than about twelve degrees (12°).

12. A reamer bit comprising:

a generally tubular body extending between a first end and a second end, the generally tubular body configured for attachment to a drill string; and a plurality of cutting elements disposed on one or more blades carried by the generally tubular body between the first end and the second end thereof, the cutting elements of the plurality defining a cutting profile spaced radially apart from a longitudinal axis of the reamer bit when the one or more blades are in an operable position, at least one cutting element of the plurality of cutting elements having a side rake angle of about five degrees (5°) or more;

wherein cutting elements of the plurality in a lower shoulder region of the cutting profile have an average side rake angle of at least about fifteen degrees (15°); and wherein the plurality of cutting elements comprises all the cutting elements carried by the reamer bit between the first end and the second end.

13. A drilling system comprising:

a pilot bit comprising a first plurality of cutting elements defining a first cutting profile of the pilot bit, the cutting elements of the first plurality in shoulder regions of the first cutting profile of the pilot bit having a first average effective back rake angle; and a reamer bit for enlarging a wellbore drilled by the pilot bit, the reamer bit comprising a second plurality of cutting elements defining a second cutting profile of the reamer bit, the cutting elements of the second plurality in shoulder regions of the second cutting profile of the reamer bit having a second average effective back rake angle that is greater than the first average effective back rake angle.

14. The drilling system of claim 13, wherein the second average effective back rake angle is at least about one and one-half (1.5) times the first average effective back rake angle.

15. The drilling system of claim 13, wherein the second average effective back rake angle is at least about fifteen degrees (15°) or more, and the first average effective back rake angle is less than about ten degrees (10°).

16. The drilling system of claim 13, wherein the second average effective back rake angle is at least about two (2) times the first average effective back rake angle.

17. The drilling system of claim 13, wherein the cutting elements of the first plurality in the shoulder regions of the first cutting profile of the pilot bit have a first average side rake angle, and the cutting elements of the second plurality in the shoulder regions of the second cutting profile of the reamer bit have a second average side rake angle that is greater than the first average side rake angle.

18. The drilling system of claim 17, wherein the first average side rake angle is less than five degrees (5°), and the second average side rake angle is greater than five degrees (5°).

19. The drilling system of claim 18, wherein the second average side rake angle is at least about ten degrees (10°).

20. A drilling system comprising:

a pilot bit comprising a first plurality of cutting elements defining a first cutting profile of the pilot bit; and a reamer bit for enlarging a wellbore drilled by the pilot bit, the reamer bit comprising a second plurality of cutting elements defining a second cutting profile of the reamer bit, at least one cutting element of the second plurality of cutting elements having a side rake angle of about five degrees (5°) or more, wherein cutting elements of the second plurality of cutting elements in a lower shoulder region of the second cutting profile have a first average side rake angle, and wherein cutting elements of the second plurality of cutting elements in an upper shoulder region of the second cutting profile have a second average side rake angle less than the first average side rake angle.

21. The drilling system of claim 20, wherein the first average side rake angle is greater than about twelve degrees (12°), and the second average side rake angle is less than about twelve degrees (12°).

22. The drilling system of claim 21, wherein the first average side rake angle is about fifteen degrees (15°) or more, and the second average side rake angle is about ten degrees (10°) or less.

23. The drilling system of claim 20, wherein cutting elements of the second plurality of cutting elements in a lower shoulder region of the second cutting profile have an average side rake angle of at least about fifteen degrees (15°).

24. The drilling system of claim 23, wherein cutting elements of the first plurality of cutting elements in shoulder regions of the first cutting profile of the pilot bit have an average side rake angle of about ten degrees (10°) or less.

25. A method of drilling a wellbore in a subterranean formation, comprising:

selecting a pilot bit having a first plurality of cutting elements in shoulder regions of a cutting profile of the pilot bit, the cutting elements of the first plurality having a first average effective back rake angle;

selecting a reamer bit having a second plurality of cutting elements in shoulder regions of a cutting profile of the reamer bit, the cutting elements of the second plurality having a second average effective back rake angle greater than the first average effective back rake angle;

drilling a pilot bore using the pilot bit; and reaming the pilot bore with the reamer bit while drilling the pilot bore using the pilot bit.

26. The method of claim 25, wherein selecting the reamer bit comprises selecting a reamer bit having a second plurality of cutting elements in shoulder regions of a cutting profile of the reamer bit, the cutting elements of the second plurality having a second average effective back rake angle greater than about one and one-half (1.5) times the first average effective back rake angle.

27. A method of forming a drilling system, comprising:

forming a pilot bit having a first plurality of cutting elements in shoulder regions of a cutting profile of the pilot bit;

positioning the cutting elements of the first plurality on the pilot bit to have a first average effective back rake angle;

forming a reamer bit having a second plurality of cutting elements in shoulder regions of a cutting profile of the reamer bit;

positioning the cutting elements of the second plurality on the reamer bit to have a second average effective back rake angle greater than the first average effective back rake angle; and securing the pilot bit and the reamer bit to a common drill string.

28. The method of claim 27, further comprising securing the cutting elements of the second plurality to the reamer bit in orientations causing the second average effective back rake angle to be greater than about one and one-half (1.5) times the first average effective back rake angle.

* * * * *